US005558543A

United States Patent [19]

Takano et al.

[11] Patent Number: 5,558,543

[45] Date of Patent: Sep. 24, 1996

[54] CONNECTOR ATTACHMENT COMPONENT

[75] Inventors: Tsunesuke Takano; Kouichi Sinzawa, both of Tokyo, Japan

[73] Assignee: Daiichi, Denso Buhin Co., Ltd., Japan

[21] Appl. No.: 386,357

[22] Filed: Feb. 9, 1995

[30] Foreign Application Priority Data

Mar. 2, 1994 [JP] Japan ..... 6-056765

[51] Int. Cl.[6] ..... H01R 17/00

[52] U.S. Cl. ..... 439/699.2; 362/296; 439/619

[58] Field of Search ..... 439/699.1, 699.2, 439/619; 362/368–376, 296

[56] References Cited

U.S. PATENT DOCUMENTS

| | | | |
|---|---|---|---|
| 4,081,668 | 3/1978 | Mori | 362/376 |
| 4,365,396 | 12/1982 | Baba et al. | 439/699.2 |
| 4,894,027 | 1/1990 | Brantingham et al. | 439/699.2 |
| 4,992,918 | 2/1991 | Shioiri et al. | 362/372 |
| 5,008,588 | 4/1991 | Nakahara | 439/699.2 |
| 5,013,961 | 5/1991 | Reedy | 439/699.2 |
| 5,035,655 | 7/1991 | Hesse | 439/699.2 |
| 5,061,872 | 10/1991 | Kulka | 362/348 |

*Primary Examiner*—David L. Pirlot
*Assistant Examiner*—Jill DeMello
*Attorney, Agent, or Firm*—Nixon & Vanderhye P.C.

[57] ABSTRACT

A connector attachment component for a lamp is provided with a bulb holder which includes an electrically insulative base member defining a central interior rectangular space for receiving a lamp base therewithin. A pair of electrically conductive bulb connectors have resilient generally U-shaped clamp elements for resiliently holding the lamp base, and a connection piece for connection to an electrical circuit. The pair of connectors are positioned parallel to one another within the central interior rectangular space such that each of the clamp elements forwardly extends to receive the lamp base of a lamp when inserted thereinto. An electrically conductive reflecting plate forwardly extends from an upper surface of the bulb holder so as to be in covering relationship to the lamp when the lamp base thereof is resiliently held by the clamp elements of the connectors. The reflecting plate includes an electrically conductive projecting piece which is inserted into a connection piece of one of the connectors to allow electrical current to flow through the reflecting plate to the connector and illuminate the lamp held thereby.

4 Claims, 9 Drawing Sheets

CONNECTOR ATTACHMENT COMPONENT

FIELD OF INVENTION

The present invention relates to connector attachment components adapted to attach a wedge base bulb to a supporting member. In preferred embodiments, the connector attachment components include a conductive reflecting plate which is electrically connected to the bulb.

BACKGROUND OF THE INVENTION

An example of a conventional small lamp using a wedge base bulb of the prior art is described in Japanese Examined Utility Model Publication No. 53-1825. Specifically, this example of the prior art is a small interior lamp for automobile use equipped with a housing, a lens located in the opening of the housing, a holder attached to the housing, and a wedge base bulb supported in the holder. The holder includes a holder body, formed by a bent U-shaped conductive metal strip, and an attachment piece integrated into a single unit with the holder body and extending in the opposite direction from the U-shaped conductive metal strip. A center piece and right and left side pieces are provided in opposition at selected intervals protruding from the top and bottom of the engaging indentation. The U-shaped portion of the holder body is clamped between the center piece and both the side pieces by fitting into the engaging indentation. In such a manner, therefore, the holder body is formed in the housing. In this state, the attachment piece of the holder body is fixed in the housing together with a conductive strip for connection. Since the prior art described above comprises an interior lamp by directly forming the holder portion of a wedge base bulb in the side edge of a hole in an interior lamp housing, and directly inserting a connector into a housing base, there is a tendency for the bulb to become loose due to thermal deformation of the base caused by accumulation of heat in the bulb holder. Such looseness is particularly acute when bulbs of roughly 5 W or more are used. Moreover, contact resistance increases in riveted portions resulting in a further accelerated increase in looseness, ultimately leading the interior lamp not being operational.

In addition, the prior art is also disadvantageous since the peripheral members of the connector, such as the bulb holder, have a relatively complex structure. Such a complex structure therefore typically requires manual assembly and connection thereby making it unsuitable for automated wiring and assembly systems. Furthermore, no light beam reflecting plate is provided in the prior art bulb holder, thereby promoting low light utilization efficiency.

SUMMARY OF THE INVENTION

The present invention eliminates may of the above-mentioned problems associated with the prior art while also providing an inexpensive and heat-resistant bulb-holding structure by attaching a wedge base bulb to a relatively large non-heat-resistant member via a relatively small heat-resistant holder. The present invention therefore is well suited for automated mounting of the holder to an attaching member, including the attachment of a connector to the holder, by having a conductive reflecting plate also serve as a portion of the connector.

The present invention is embodied in a connector attachment component having a bulb holder comprised of a generally square cylindrically shaped insulating base formed of heat-resistant plastics material having projections which protrude from opposing surfaces of the insulating base. A pair of connectors each having a pair of U-shaped clamps formed of a resilient conductive strip and an insertion connection piece, formed on a rising base of its side edge, are integrated into a single unit. The connectors are respectively mounted in parallel between the opposing surfaces of the insulating base via the projections at an attachment hole formed in the base portion of the clamps. A conductive reflecting plate is fastened to the upper surface of the bulb holder such that electrical current is able to flow to a connector via the conductive reflecting plate. In this regard, the conductive reflecting plate is placed on the upper surface of the bulb holder and is tightly inserted by means of its conductive projecting piece.

Furthermore, opposing pieces may also be formed separated from the inner side surface by side relief holes. A conductive reflecting plate having an attaching portion that matches its contour can be mounted on the upper surface of an insulating base by inserting its conductive projecting piece into a connector.

As a result of forming an insertion connection piece, having a pair of clamps and an insertion connection piece, into a single unit with a single connector, a wedge base bulb can be tightly clamped in place with a pair of clamps. A tab terminal and BUS bar can thus be connected by inserting a conductive projecting piece of the conductive reflecting plate into one insertion connection piece and tightly inserting the tab terminal and BUS bar into the other connection piece. Since the connector itself within the bulb holder is surrounded by a heat-resistant insulating base, two connectors can be mounted with favorable compatibility via this insulating base irrespective of conductive plates and non-heat-resistant insulating plates.

The outer surfaces of the locking tabs of the insulating base can be pressed between the edges of the mounting hole of the attaching body. Thus, after the edges are pushed in the direction in which the side relief holes become narrower in opposition to their resiliency, the sides are locked with a single snapping action as they return to their original state as a result of the locking tabs being released from the edges of the mounting hole. In such a manner, the bulb holder to be easily mounted to the attaching body at its mounting hole. When in this mounted state, vertical movement of the insulating base with respect to the attaching body is restricted since the opposing hook edges of the pair of locking tabs make contact with the respective upper and lower surfaces of the attaching body, thus preventing rattling. In addition, horizontal movement of the insulating base is restricted with the peripheral edges of the mounting hole of the attaching body which also preventing rattling.

If the opposing pieces are formed separated from the inside of the side edges of the bulb holder by side relief holes, the side opposing pieces of the connector can be cooled by the flow of air through the above-mentioned holes. Moreover, in the present invention, the wedge base bulb can be illuminated by allowing current to flow to the conductive reflecting plate via a BUS bar which projects out towards its rear portion.

DETAILED DESCRIPTION OF THE PREFERRED EXEMPLARY EMBODIMENTS

Figure 1:
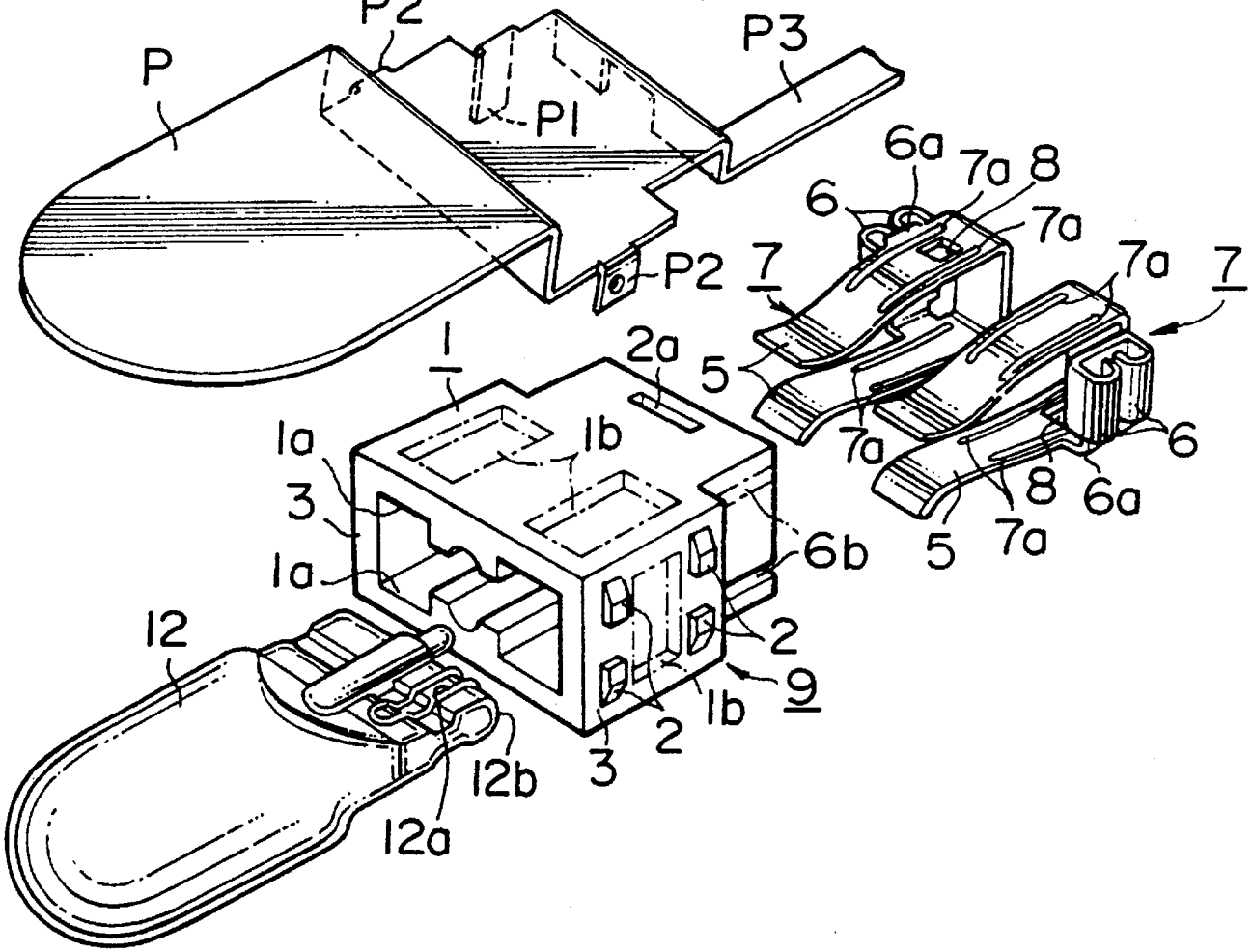
FIG. 1 is an exploded perspective view of the connector attachment component of the present invention.

As shown in FIG. 1, the connection attachment component of this invention generally includes an insulating base 1 forming a bulb holder 9 which receives and holds a wedge base bulb 12 therein. The insulating base has, for example, two pairs (e.g., a total of four) locking tabs 2 molded near the top and bottom of left and right sides 3 of insulating base 1. The insulating base 1 is formed from a heat-resistant plastics material, such as Nylon 66, and is formed into an inverted generally T-shaped square cylindrical frame.

Figure 3:
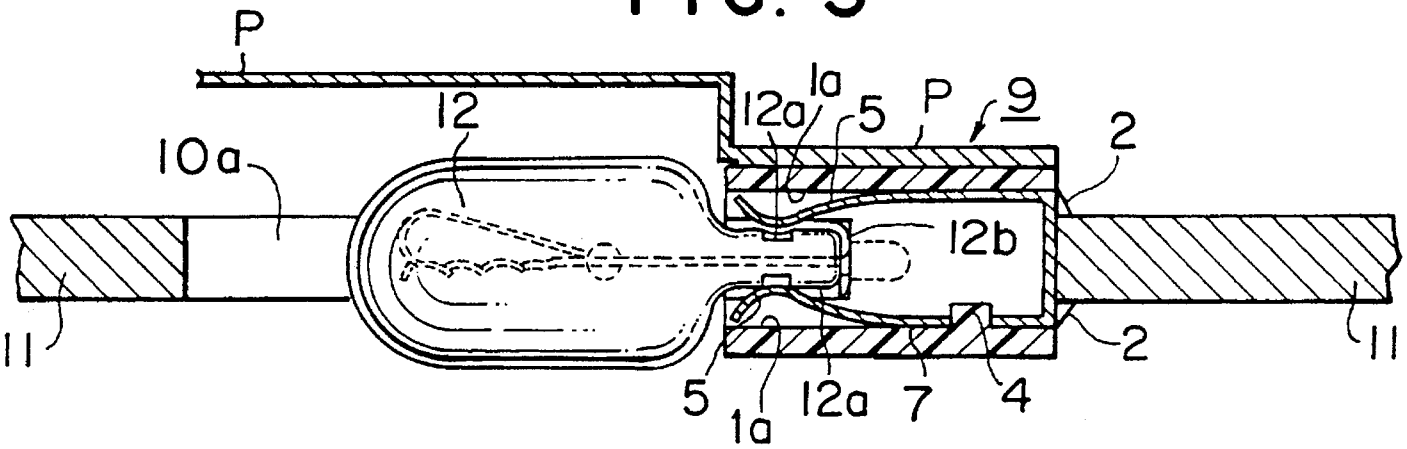
FIG. 3 is a cross-sectional view taken along line 3—3 of FIG. 2.
Figure 4:
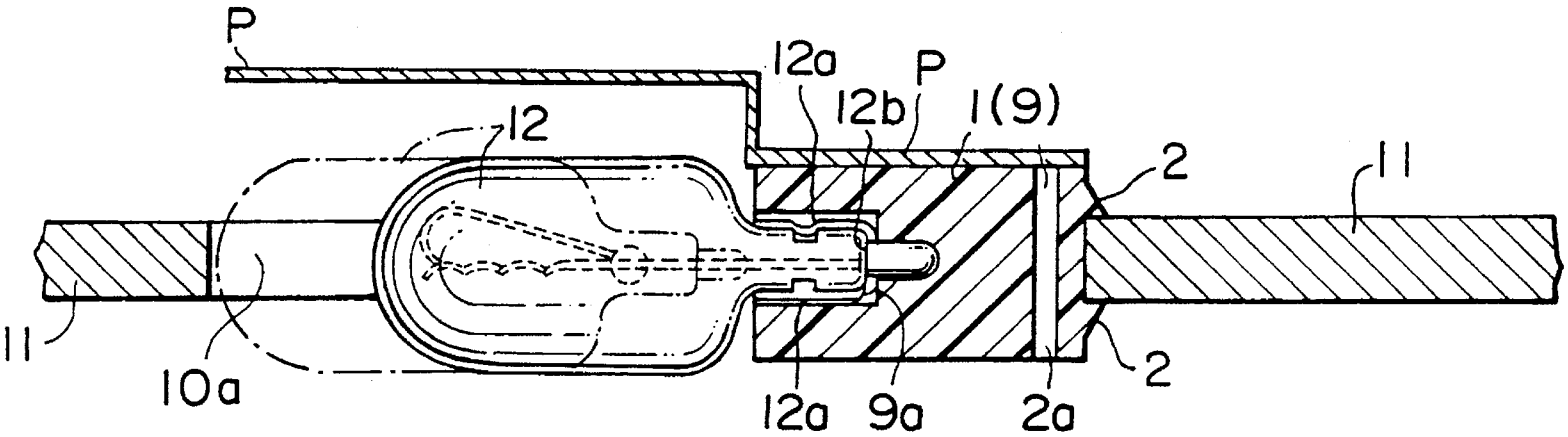
FIG. 4 is a cross-sectional view taken along line 4—4 of FIG. 2.
Figure 6:
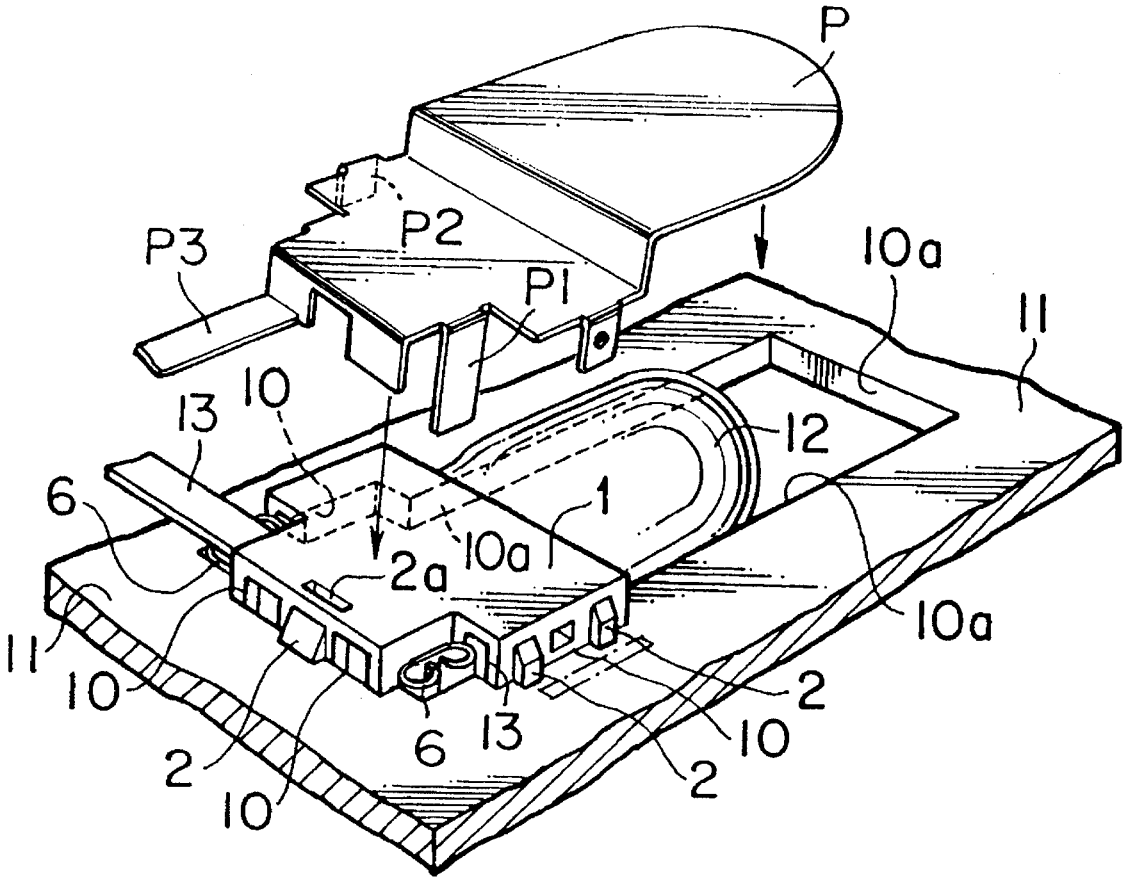
FIG. 6 is a rear perspective view showing partial assembly of the connector attachment component of the present invention.

The upper and lower locking tabs 2 may be formed together with rear surface relief hole 2*a* on the rear surface of base 1 as shown in FIG. 4. The rear portion of the base 1 may therefore be resiliently locked to the edge of the supporting body 11 as shown in FIGS. 4 and 6. Projections 4 protrude from opposing surfaces 1 a on the top and bottom of the insulating base 1 as shown in FIG. 3. Two connectors 7 are each provided with a pair of generally U-shaped clamps 5 formed from resilient conductive strips made of phosphor bronze and the like. Eyeglass-shaped insertion connection piece 6 is formed integrally on the rising base 6*a* at the side edge portion of each of the connectors 7. The connectors 7 are thus clamped within the insulating base 1 as shown in FIGS. 3 through More specifically, the bulb holder 9 is formed by inserting rising base 6*a* of connection piece 6 into base side groove 6*b* while inserting the clamps 5 between opposing surfaces 1*a* against their inherent resiliency. The projections 4 will thus be received within the attachment holes 8 formed in the connection piece base so as to mount the connectors 7 on both sides between base opposing surfaces 1*a* as shown in FIG. 3. Clamping resiliency may be strengthened and heat radiation improved by providing two protruding ribs 7*a* on the connectors 7 as shown in FIG. 1.

According to the present invention, a conductive reflecting plate P as shown in FIGS. 1 and 6 equipped with a downwardly projecting conductive projecting piece P1 is inserted into a respective one of the connection pieces 6 of a connector 7. As such, electrical current is allowed to flow simultaneously to the connector by virtue of its being inserted and fixed to the connection piece 6.

Figure 7:
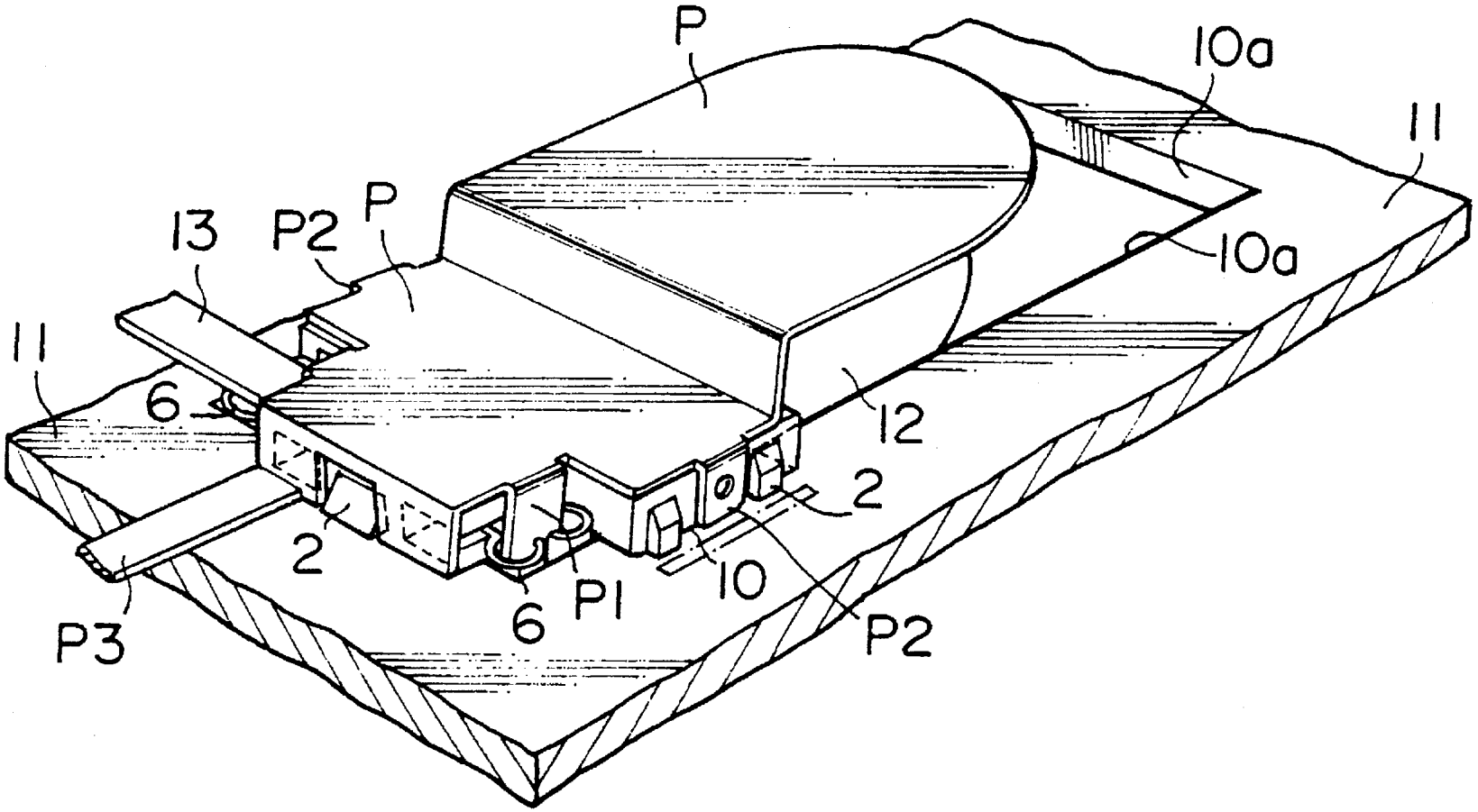
FIG. 7 is a perspective view following assembly of the connector attachment component shown in FIG. 6.

In addition, reflecting plate P can also be attached and mounted as shown in FIGS. 3, 4 and 7 on the upper surface of insulating base 1 with resilient locking tabs P2 projecting downwardly on both of its sides. The conductive projecting piece P1 may also be attached to connection piece 6 by means of screws, adhesives and the like, in which case the resilient locking tabs P2 may be omitted.

The connector attachment component according to the present invention is then constructed by mounting the bulb holder 9 to supporting body 11. In this regard, the supporting body 11 defines a mounting hole 10 which is sized slightly larger than the planar contour of the insulating base 1. An auxiliary hole 10*a* is also defined by the supporting body in conjunction with the mounting hole 10 so as to accommodate insertion and removal of the bulb 12 from the bulb holder 9.

Figure 8:
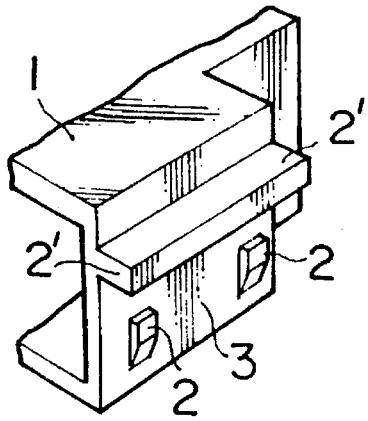
FIG. 8 is a perspective view of a portion of the bulb holder showing another example of the locking tabs.
Figure 9:
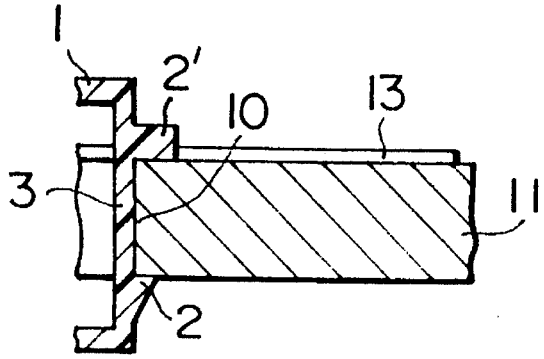
FIG. 9 is a partial cross-sectional view showing the manner in which the bulb holder shown in FIG. 8 may be locked to a support member.

The bulb holder 9 may also be mounted in supporting body 11 as shown in FIG. 9. Specifically, the insulating base 1 may be provided with a with planar hood-shaped projection 2' which is spaced from the lower pair of locking tabs 2 as shown in FIG. 8.

Figure 2:
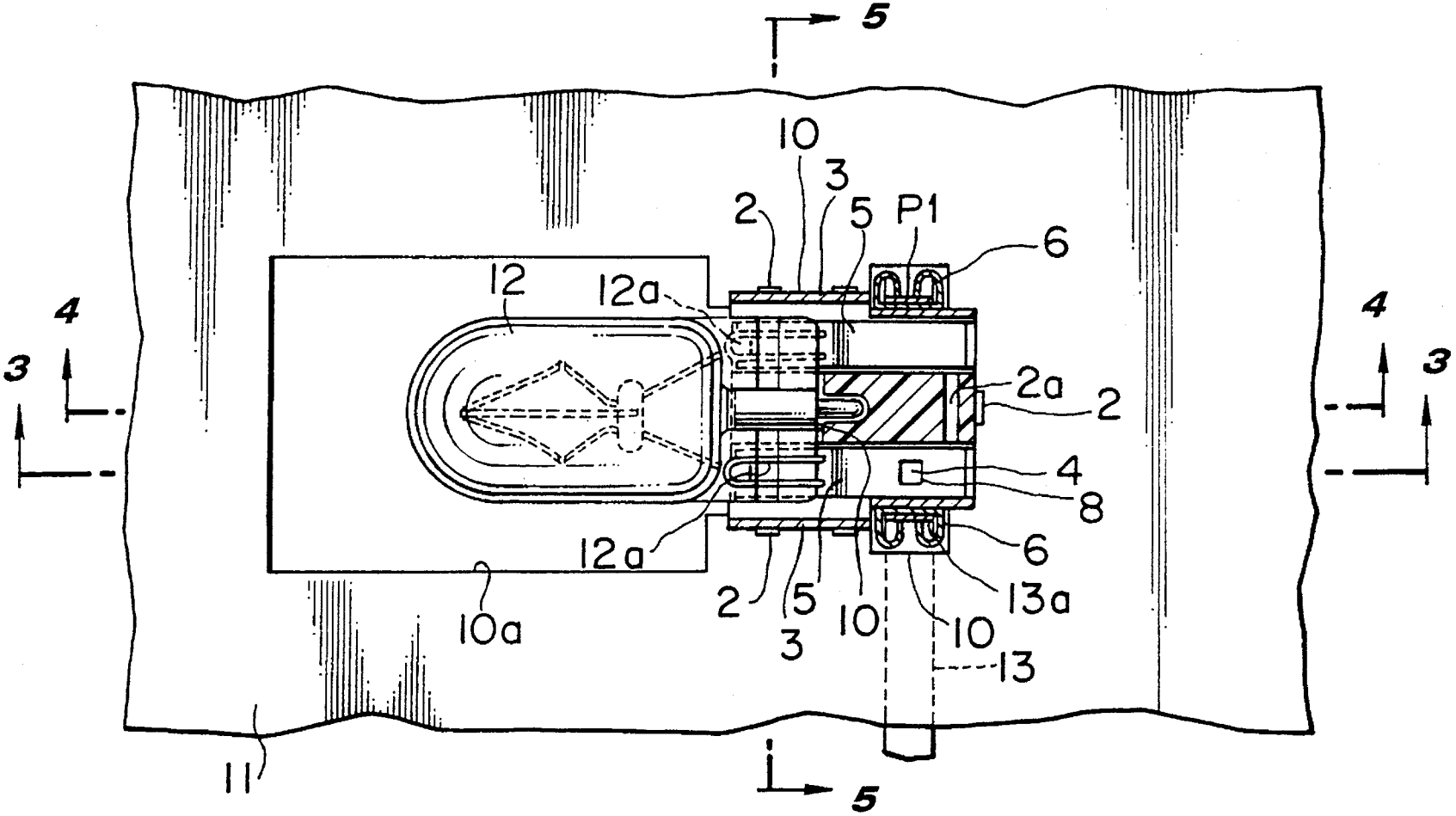
FIG. 2 is a cross-sectional overhead view of the connector attachment component of the present invention.
Figure 5:
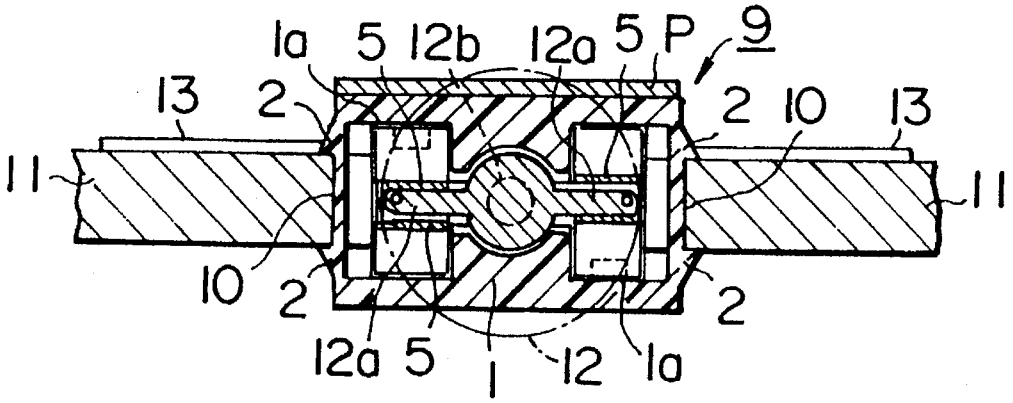
FIG. 5 is a cross-sectional view taken along line 5—5 of FIG. 2.

A conventional wedge base bulb as shown in FIG. 1 may be inserted into bulb holder 9 at its base portion from the state indicated by the broken line of FIG. 4 as shown by the solid line of that same drawing as well as FIGS. 3 and 5. At this time, the bulb 12 can be inserted into holder 9 in parallel with the lower surface of the conductive reflecting plate P by first inserting the bulb 12 until the bulb base 12*b* makes contact with holder ledge 9*a*. Upon insertion of the bulb base 12*b*, the clamps 5 of connectors 7 are pushed apart in opposition to their resiliency so as to tightly clamp the lead portions 12*a* of bulb 12. The wedge base bulb 12 can then be illuminated by tightly inserting curved portions 13*a* of BUS bars 13, arranged along the surface of supporting body 11 as shown in FIGS. 2 and 7, into the insertion connector piece 6 of one of the connectors 7 of bulb holder 9. The conductive projecting piece P1 of the reflecting plate P is inserted beforehand into the connector piece 6 of the other connector 7. Therefore, by supplying current to the conductive reflecting plate P, the bulb 12 may be illuminated since the bulb 12 will be in the electrical circuit formed with BUS bar 13.

Figure 10:
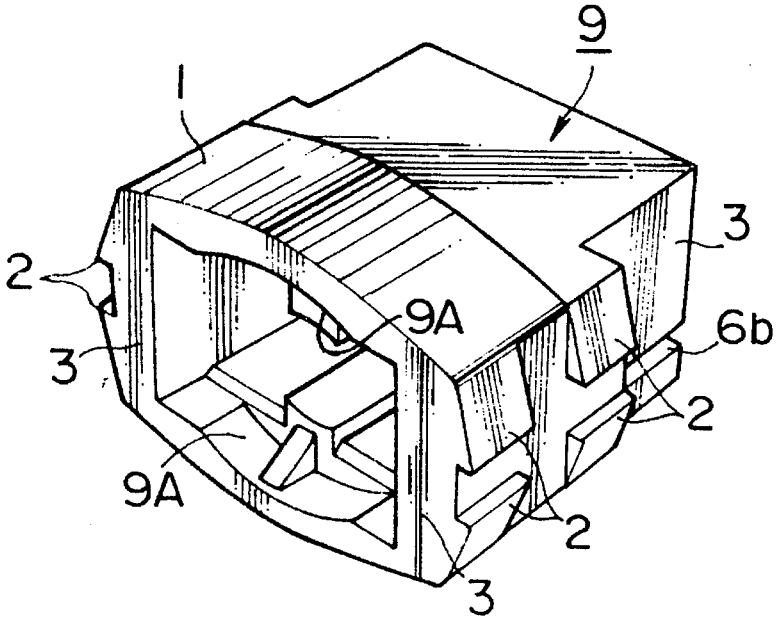
FIG. 10 is a perspective view showing another example of a bulb holder that may be employed in the connector attachment component of this invention.

Support 9A may be formed on the front surface of bulb holder 9 as shown in FIG. 10 so as to provide support to the bulb 12 by engagement with the bulb's rounded portion.

Figure 11:
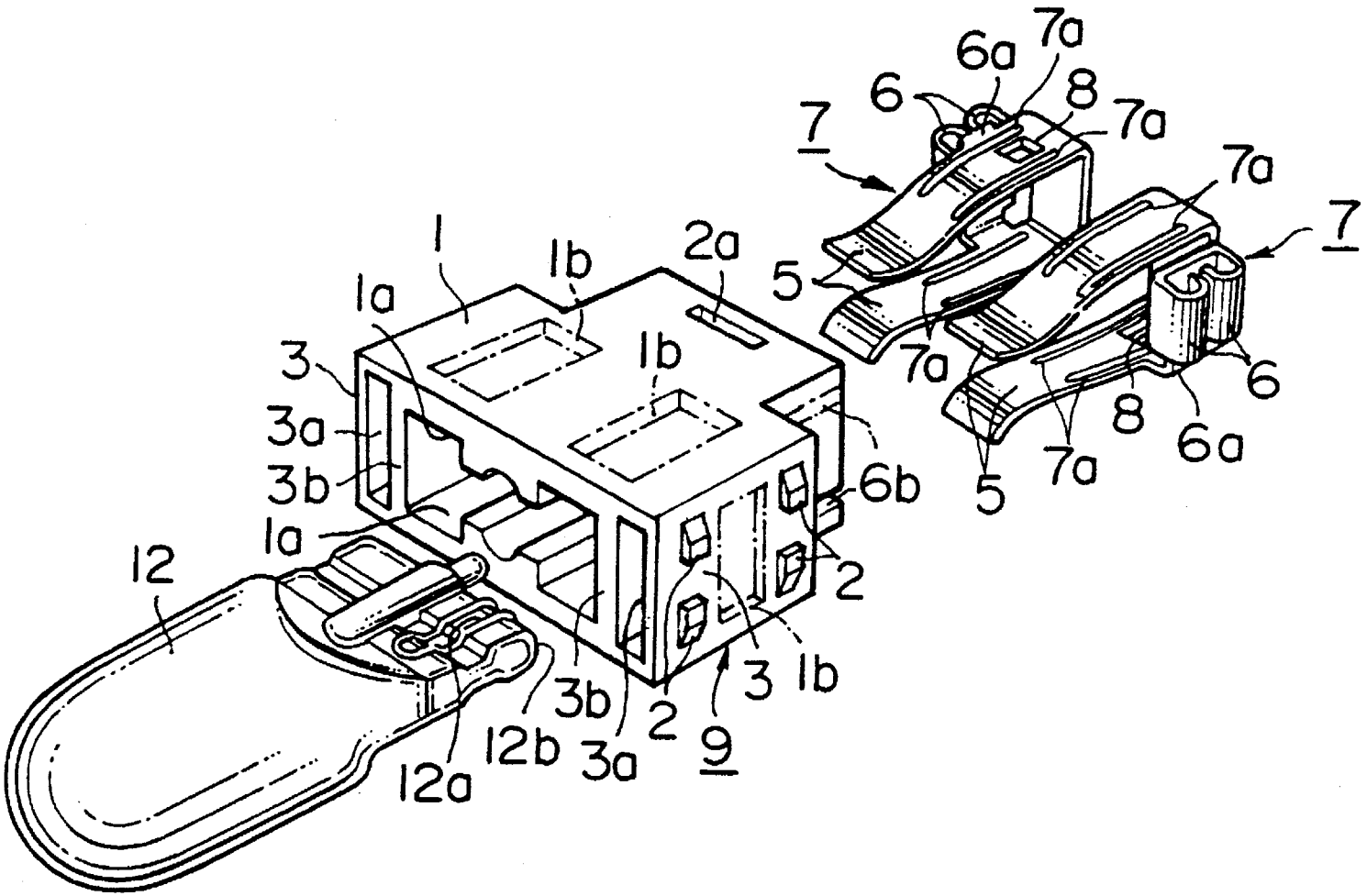
FIG. 11 is a perspective view showing another example of a bulb holder that may be employed in the connector attachment component of this invention.
Figure 12:
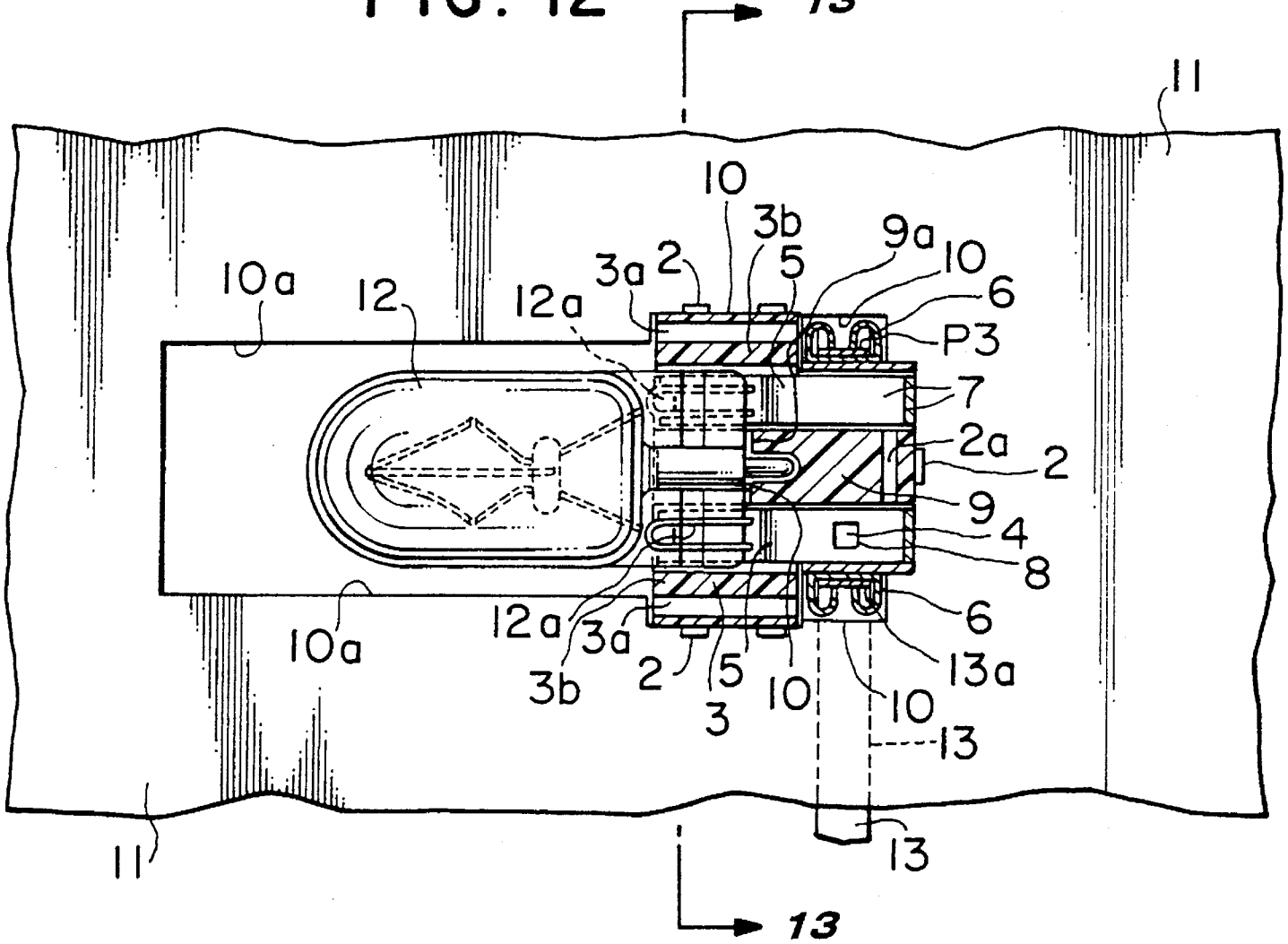
FIG. 12 is a plan view, partly in section, of the bulb holder shown in FIG. 11 mounted to a support structure.
Figure 13:
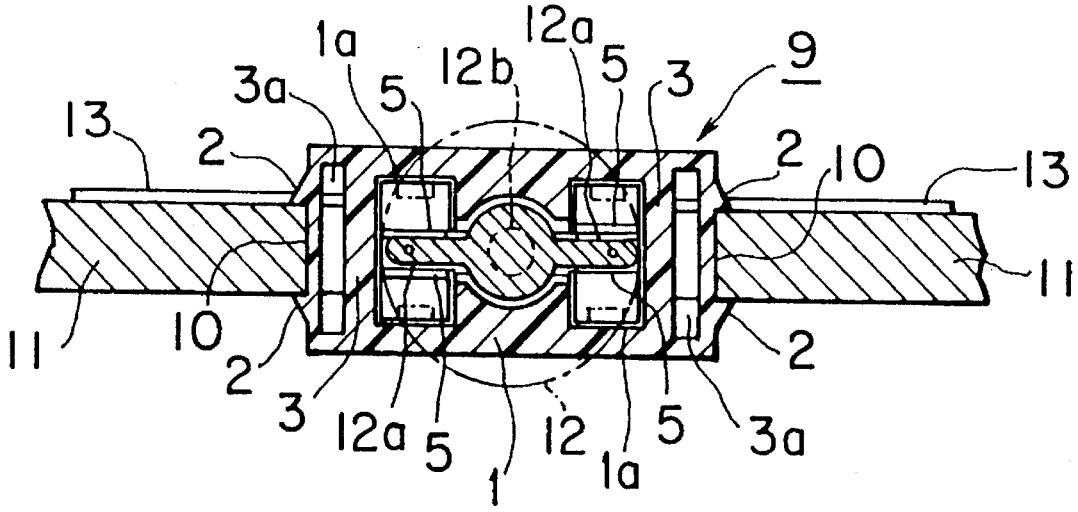
FIG. 13 is a cross-sectional view taken along line 13—13 of FIG. 12.

The bulb holder 9 may also be constructed as shown in FIGS. 11–13. That is, the bulb holder may include opposing pieces 3*b* separated from the inner surface of the side 3 so as to establish relatively narrow, long side relief holes 3*a*.

Thus, according to the present invention, the conductive reflecting plate P serves the dual purpose of reflecting light from the bulb 12 while also serving as an electrical conductor in the circuit. That is, electrical current is capable of flowing through the plate P to the bulb 12. As such, the component parts of the present invention may be reduced thereby facilitating its automated assembly. Therefore, both labor and parts costs may be reduced.

What is claimed is:

1. A connector attachment component for a lamp comprising:

a bulb holder which includes an electrically insulative base member defining a central interior rectangular space for receiving a lamp base therewithin;

a pair of electrically conductive bulb connectors each having a resilient generally U-shaped clamp element for resiliently holding the lamp base, and a connection piece for connection to an electrical circuit, said pair of connectors being positioned parallel to one another within said central interior rectangular space such that each said clamp element forwardly extends to receive the lamp base of a lamp when inserted thereinto; and an electrically conductive reflecting plate forwardly extending from an upper surface of said bulb holder so as to be in covering relationship to the lamp when the lamp base thereof is resiliently held by said clamp elements of said connectors, wherein said reflecting plate includes an electrically conductive projecting piece which is inserted into a connection piece of one of said connectors to allow electrical current to flow through the reflecting plate to the connector and illuminate the lamp held thereby.

2. A connector attachment component as in claim 1, wherein said connectors each include attachment holes, and wherein said electrically insulative base member includes attachment projections each received within a respective one of said attachment holes so as to attach said connector to said base member.

3. A connector attachment component as in claim 1, wherein said electrically insulative base member includes a pair of side walls each having pairs of outwardly protruding locking tabs for attaching said base member to supporting structure.

4. A connector attachment component as in claim 1, wherein said electrically insulative base member includes a pair of side walls, and inner walls each spaced from a respective opposed one of said side walls so as to establish therebetween an elongate relief hole.

* * * * *